US006840461B1

(12) United States Patent
Burke et al.

(10) Patent No.: US 6,840,461 B1
(45) Date of Patent: Jan. 11, 2005

(54) ADAPTER CLAMP FOR AEROSOL CAN

(75) Inventors: Terrence R. Burke, Kirkwood, MO (US); Lee M. White, Manchester, MO (US); Jonathan D. Berger, St. Louis, MO (US)

(73) Assignee: Whitmire Micro-Gen Research Laboratories, Inc., St. Louis, MO (US)

( * ) Notice: Subject to any disclaimer, the term of this patent is extended or adjusted under 35 U.S.C. 154(b) by 0 days.

(21) Appl. No.: 10/679,237

(22) Filed: Oct. 3, 2003

(51) Int. Cl.[7] ..... B05B 9/00
(52) U.S. Cl. ..... 239/337; 248/316.7; 239/302
(58) Field of Search ..... 248/316.1, 316.7, 248/65; 220/319, 320; 215/276; 239/302, 316, 337, 600

(56) References Cited

U.S. PATENT DOCUMENTS

| | | | | | |
|---|---|---|---|---|---|
| 2,670,882 | A | * | 3/1954 | Best | 222/464.1 |
| 3,531,071 | A | * | 9/1970 | Kubli | 248/68.1 |
| 3,580,424 | A | * | 5/1971 | Philipps | 222/89 |
| 3,785,225 | A | | 1/1974 | McKenna et al. | |
| 3,885,477 | A | | 5/1975 | Shook | |
| 4,059,033 | A | | 11/1977 | Johnson | |
| 4,446,987 | A | * | 5/1984 | White | 222/3 |
| 4,632,352 | A | * | 12/1986 | Stoll | 248/313 |
| 4,648,388 | A | * | 3/1987 | Steffee | 606/61 |
| 4,805,938 | A | * | 2/1989 | Redmond et al. | 280/47.35 |
| 5,003,848 | A | | 4/1991 | Ceccucci, Jr. | |
| 5,161,436 | A | | 11/1992 | Stevenson | |
| 5,184,911 | A | * | 2/1993 | Wu | 403/385 |
| 5,213,016 | A | | 5/1993 | Kah, Jr. | |
| 5,329,726 | A | | 7/1994 | Thorne et al. | |
| 5,562,219 | A | * | 10/1996 | de Pous et al. | 215/274 |
| 5,735,181 | A | | 4/1998 | Anderson | |
| 5,860,728 | A | * | 1/1999 | Maglica | 362/191 |
| 6,003,266 | A | | 12/1999 | Woodruff | |
| 6,370,811 | B1 | | 4/2002 | Masterson | |
| 6,618,905 | B2 | * | 9/2003 | Warashina et al. | 16/426 |

* cited by examiner

*Primary Examiner*—Leslie A. Braun
*Assistant Examiner*—Steven Marsh
(74) *Attorney, Agent, or Firm*—Senniger Powers

(57) ABSTRACT

An adapter clamp that enables a delivery system to be connected to an aerosol can. The adapter clamp includes a pair of body members oriented in a side-by-side relationship having an arcuate cutout in an medial face that combine to form an aperture through which the delivery system contacts the aerosol can. Each body member has an arcuate neck with an outward protruding toe extending from a bottom surface thereof configured to be received in an annular recess of the aerosol can and engage a rim of the can. The adapter clamp also includes at least one connector slidably joining the body members such that the members are adapted to slide between a spread configuration wherein the members have a gap between the body members and a compressed configuration wherein the members substantially abut each other so that the toes may be inserted past the rim and into the recess of the aerosol can. The adapter clamp also includes at least one spring member configured to push the body members apart thereby biasing the members in the spread configuration.

19 Claims, 4 Drawing Sheets

ADAPTER CLAMP FOR AEROSOL CAN

BACKGROUND OF THE INVENTION

This invention is related to aerosol dispensers, and more particularly, to an adapter clamp that enables a delivery system to be connected to the top of an aerosol can.

Aerosol cans dispense a variety of ingredients for use in a wide range of applications including disinfectants, paints, antiperspirants, deodorants and insecticides. Typically, an active ingredient is mixed with a solvent, and the mixture is pressurized with a propellant and stored under pressure in the aerosol can. Aerosol cans generally include a port at one end that is normally closed off by an internal valve which, when opened, allows the pressurized mixture therein to escape through the valve stem.

The active mixture is typically sprayed by pushing down/sideways on the valve stem with an actuator located at the top of the can that displaces the valve. The pressure on the actuator is typically supplied by finger pressure. In some instances, such as when using insecticides, it is sometimes desirable to attach a delivery system, such as a hose or a wand, to the aerosol can to extend the reach or to more accurately direct the contents of the aerosol can to corners, crevices, pits, hollows and other areas which are difficult to access. Although various adapter devices have been available heretofore to couple a delivery system with the aerosol can, there is a need for a new and improved adapter clamp for quickly and easily connecting and/or disconnecting the delivery system to an aerosol can.

SUMMARY OF THE INVENTION

Among the several objects and features of the present invention may be noted the provision of an adapter clamp suitable for connecting a delivery system to an aerosol can; the provision of such a clamp that connects quickly to the aerosol can; the provision of such an adapter clamp which is reliable; and the provision of such an adapter clamp that is economical.

In one embodiment, the invention comprises an aerosol application system. The aerosol application system includes an aerosol can with a valve having a pedestal and a mounting cup forming an annular recess around the pedestal and a rim overhanging a portion of the recess. The aerosol application system also includes a delivery system with an adapter having a threaded portion. The aerosol application system also includes an adapter clamp for connecting the delivery system to the aerosol can. The adapter clamp includes a pair of body members oriented in a side-by-side relationship such that medial faces of the clamp members are in a facing relationship. Each of the members have an arcuate cutout in the medial face, the arcuate cutouts combining to form an aperture through which the delivery system contacts the aerosol can. Each body member has an arcuate neck with a radially protruding toe extending from a bottom surface thereof in registration with the arcuate cutout and configured to be received in the recess in the aerosol can. The adapter clamp also includes at least one connector slidablyjoining the body members such that the members are adapted to move between a spread configuration wherein the body members have a gap therebetween having a selected width and a compressed configuration wherein the members substantially abut each other. The aperture has a circular shape when the body members are in the spread configuration for receiving the threaded portion of the adapter. The adapter clamp also has at least one spring member configured to push the body members apart thereby biasing the members to the spread configuration. When the body members are squeezed together in the compressed configuration against spring pressure, the toes can be inserted past the rim overhanging the recess. When the body members are returned to the spread configuration, the toes engage the overhanging rim to clamp the adapter clamp to the aerosol can.

In another aspect, the invention is an adapter clamp configured to be received on the top of an aerosol can suitable for enabling a delivery system to be fitted to the top of the aerosol can. The adapter clamp includes a pair of body members oriented in a side-by-side relationship such that medial faces of the clamp members are in a facing relationship. Each body member has an arcuate cutout in the medial face, the arcuate cutouts combining to form an aperture through which the delivery system contacts the aerosol can. Each body member has an arcuate neck with a radially protruding toe extending from a bottom surface thereof in registration with the arcuate cutout and configured to be received in a recess in the top of the aerosol can. The adapter clamp also includes at least one connector slidably joining the body members such that the members are adapted to move between a spread configuration wherein the body members have a gap therebetween having a selected width and a compressed configuration wherein the members substantially abut each other. The aperture has a circular shape when the body members are in the spread configuration for receiving an adapter of the delivery system. The adapter clamp also has at least one spring member configured to push the body members apart thereby biasing the members to the spread configuration. When the body members are squeezed together to the compressed configuration against spring pressure, the toes can be inserted past a rim partially overhanging the recess in the aerosol can. When the body members are returned to the spread configuration, the toes engage the overhanging rim to clamp the adapter clamp to the aerosol can.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
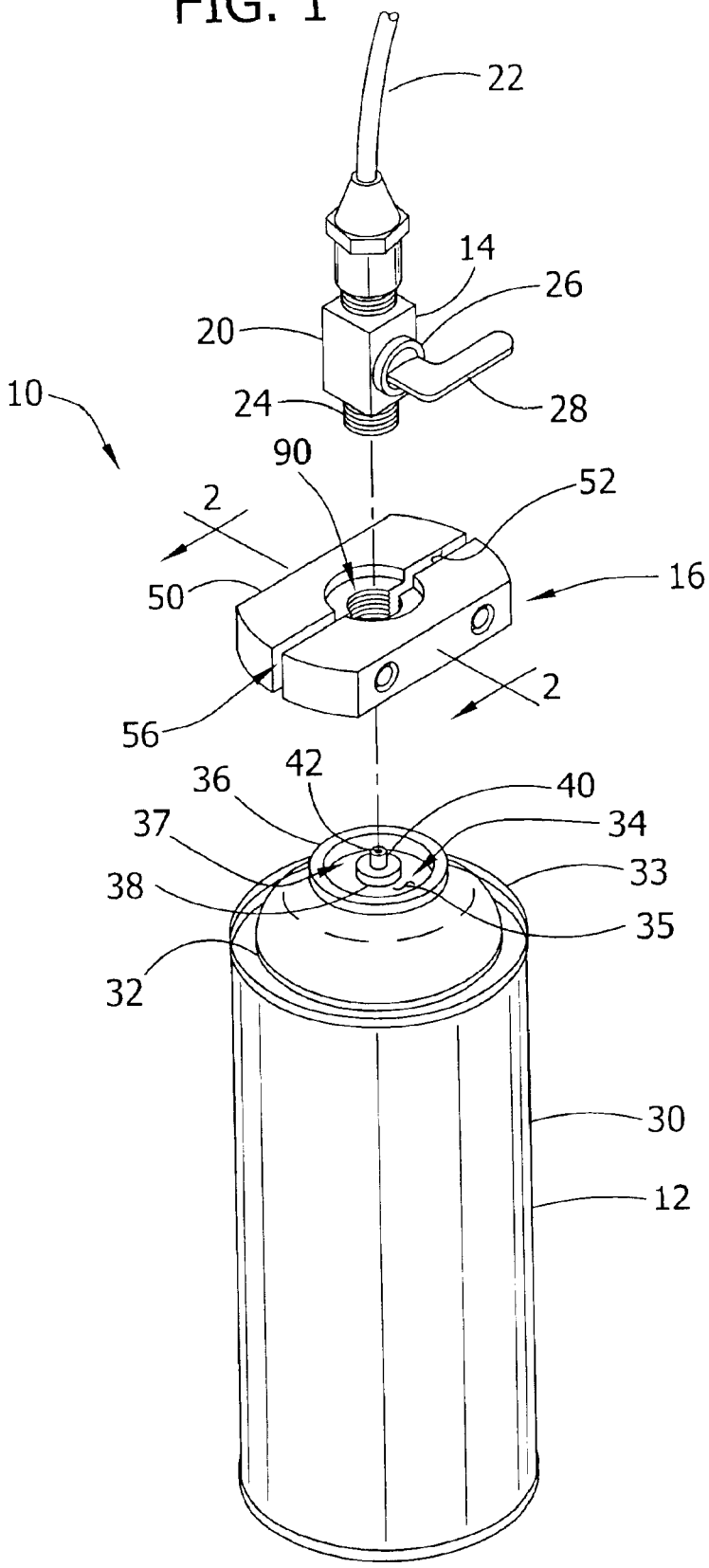
FIG. 1 is an exploded perspective view of an aerosol application system having an adapter clamp for connecting a delivery system to an aerosol can according to the invention.

Referring now to drawings, FIG. 1 illustrates an isometric exploded view of an aerosol application system, indicated generally at 10, having an aerosol can 12, a delivery system 14, and an adapter clamp 16 for connecting the delivery system to the aerosol can. The adapter clamp 16 is used to connect conventional delivery systems 14 with the aerosol cans 12. Furthermore, although the adapter clamp 16 is particularly adapted for connecting the delivery system 14 with an aerosol can 12, it will be understood that the adapter clamp may be used to connect the delivery system 14 to other types of cans or containers.

The delivery system 14 includes an adapter 20 fluidly connected with a suitable length of hose 22. The hose 22 is connected to an applicator (not shown) for application of the contents of the aerosol can 12. The applicator may be conventional in design, such as a trigger activated nozzle, a wand, or other application device known to those skilled in the art. The adapter 20 has an externally threaded portion 24 adapted to be screwed into the adapter clamp 16 to fluidly connect the delivery system 14 to the aerosol can as will be described below. The hose 22 is suitably made of a flexible material and can be constructed from plastic, rubber, or other flexible material for ease of directing the applicator. The adapter 20 can be constructed of any suitable material, such as metal and more suitably brass. In one embodiment, the adapter 20 also contains a valve 26 of suitable construction to control fluid flow to the hose 22. As shown, the valve 26 includes a control handle 28 which can be manually actuated between an open position and a closed position. Additionally, it is contemplated that the valve 26 may be a check valve without departing from the scope of the invention.

Figure 2:
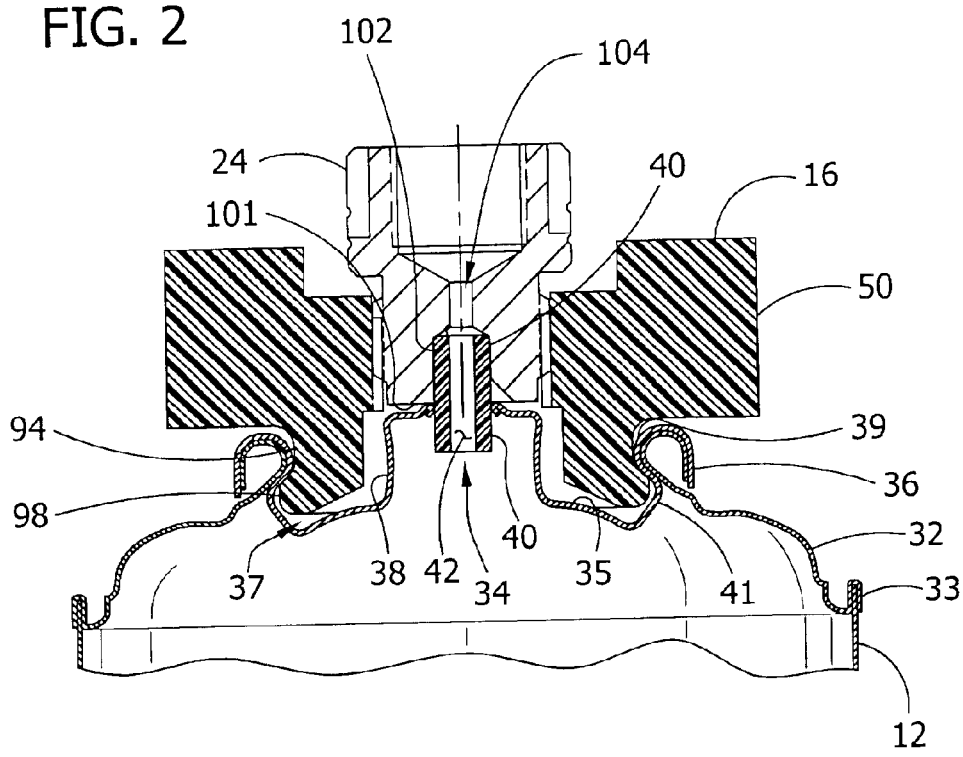
FIG. 2 is a section view of the aerosol application system of FIG. 1.
Figure 3:
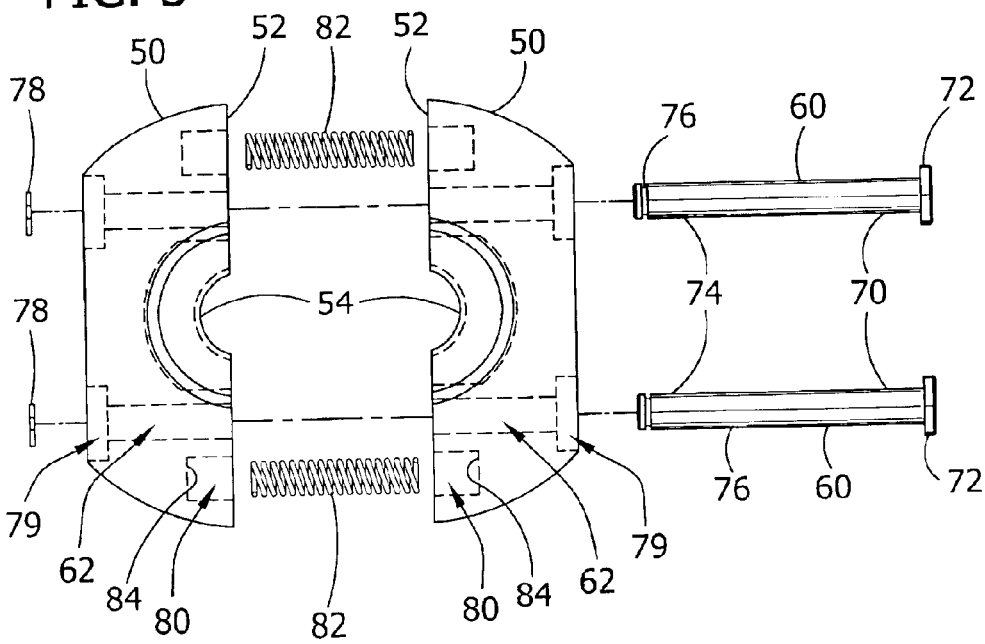
FIG. 3 is an exploded top plan view of the adapter clamp of FIG. 1.
Figure 4:
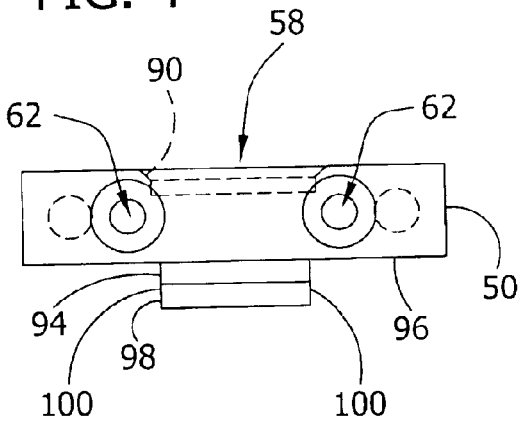
FIG. 4 is a side elevation of the adapter clamp of FIG. 1.

The aerosol can 12 has a conventional annular body wall 30 connected to an upper dome 32 at seam 33. Mounted in the dome 32 is a valve, indicated generally at 34. In one embodiment, the valve 34 is a 1.0 inch conical cup valve, although other valve sizes and configurations may be used. The valve 34 has a mounting cup 35 sealed with the dome 32 at curl 36. The mounting cup 35 defines an annular recess 37 between the curl 36 and an internal pedestal 38. Referring to FIG. 2, a portion of the mounting cup 35 curves to form a rim 39 overhanging a portion of the recess 37 and a dimple 41 and so that a cross-section of the recess has a generally boot-like shape. A valve stem 40 containing an aerosol delivery passage 42 extends through the pedestal 38 and provides an interface with the contents of the aerosol can 12. When the valve stem 40 is depressed, the contents of the aerosol can 12 are expelled through the delivery passage 42 as will be understood by one skilled in the art.

Figure 5:
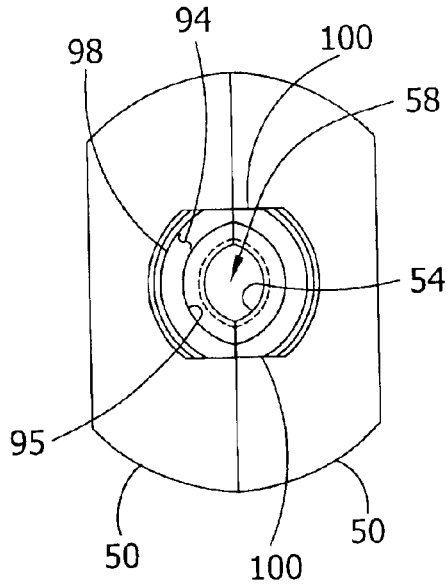
FIG. 5 is a bottom plan view of the adapter clamp of FIG. 1 in a compressed configuration.
Figure 6:
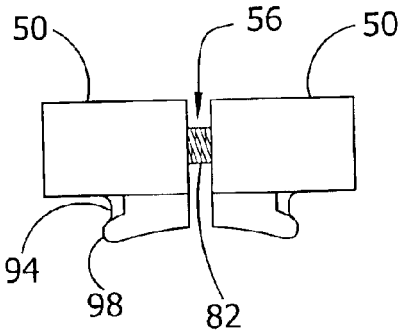
FIG. 6 is an end elevation of the adapter clamp in an extended condition.
Figure 7:
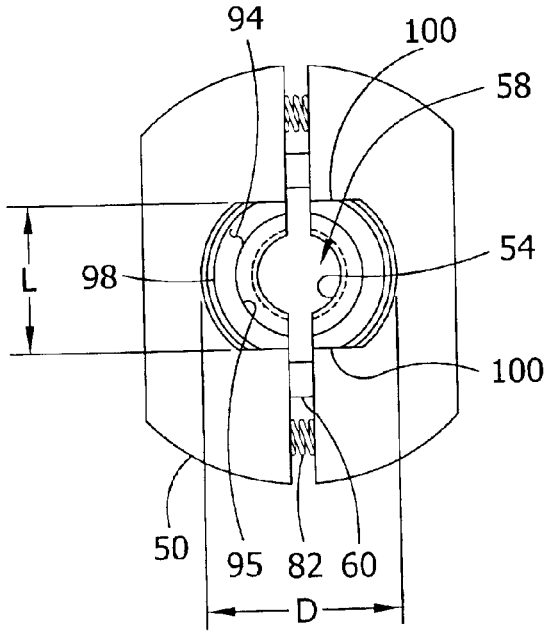
FIG. 7 is a bottom plan view similar to FIG. 5 with the adapter clamp in a spread configuration.

Referring now to FIGS. 3–7, in one embodiment the adapter clamp 16 is constructed with a pair of body members 50 positioned in a generally side-by-side relationship. The members 50 are generally elongate and are suitably made of nylon, but can also be made of aluminum, stainless steel or other materials without departing from the scope of the invention. In one embodiment, the body members 50 are suitably of substantially similar construction but mirror images of each other. An inner or medial face 52 of each body member 50 contains an arcuate cutout 54. The body members 50 are joined in a side-by-side arrangement with the medial faces 52 facing each other and separated by a central gap 56. The arcuate cutouts 54 in the side-by-side body members 50 combine to form an aperture 58. Suitably, the walls of the arcuate cutout 54 are threaded and the aperture 58 is configured to receive the threaded portion 24 of the adapter 20 (FIG. 1). As shown, both arcuate cutouts 54 are threaded, however it is contemplated that only one of the arcuate cutouts may be threaded. The arcuate cutouts 54 in each of the body members 50 are suitably less than a full semicircle such that when the body members are squeezed together in a compressed configuration such that the medial faces 52 are in a substantially abutting relationship (as shown in FIG. 5), the aperture 58 is generally oblong in shape. When the body members 50 are separated by the gap 56 having a selected width, the aperture 58 is circular in shape (as shown in FIG. 7) to enable the threaded portion 24 of the adapter 20 to be rotatably screwed into the adapter clamp 16 in a connecting configuration.

The two body members 50 are joined together with a pair of tie rods, broadly connectors 60, so as to permit relative movement between the body members to open or close the gap 56 between the members. In the embodiment shown, each body member 50 suitably contains a pair of connector-receiving holes 62 therein. The two connector-receiving holes 62 are suitably arranged in the body member 50 so that one hole is located on each side of the arcuate cutout 54 and the holes proceed through the entire width of the body member 50. Corresponding connector-receiving holes 62 in each of the body members 50 are aligned such that one tie rod 60 is received through a connector-receiving hole 62 in each member to join the two body members together. The tie rod 60 is received in the connector-receiving holes 62 in a slidable manner as will become apparent below. Although the illustrated embodiment comprises two connector-receiving holes 62 in each body member 50 and two tie rods 60, it is contemplated that other numbers of connector-receiving holes and tie rods, such as one or three, maybe used to join the body members without departing from the scope of the invention.

In one embodiment, the tie rod 60 has a head 72 on a first end 70 thereof. The head 72 has a diameter larger than a diameter of the connector-receiving hole 62 so as to prevent the first end 70 of the tie rod 60 from passing through the body member 50. A second end 74 of the tie rod 60 has an annular groove 76 therein. After the tie rod 60 is inserted through the body members 50, a clip 78 or other fastening device is inserted into the groove 76 in the tie rod to secure the tie rod within the body members and join the members together. The clip 78 is sized such that it is larger in at least one dimension than the diameter of the connector-receiving hole 62 so that after the clip is inserted, the body members are joined together. The groove 76 is suitably located on the tie rod 60 so as to determine the maximum width of the gap 56 when the adapter clamp 16 is in a spread configuration (i.e., separated the maximum distance permitted by the tie rod 60). The width of the gap 56 is set so that when the body members 50 are in the spread configuration, the aperture 58 has the desired circular shape (as shown in FIG. 7) thereby enabling the threaded portion 24 of the adapter 20 to be threaded into the adapter clamp 16. The gap 56 suitably has a width of at least about 0.07 inches in the spread configuration, and more suitably between about 0.10 and 0.15 inches. Alternately, it is also contemplated that the first end 70 of the tie rod 60 may also have a groove 76 and clip 78 arrangement substantially similar to the second end 74 instead of the head 72. The head 72 and/or clips 78 may be received in recessed cavities 79 (FIG. 3) in the body members 50 to provide flush outer surfaces on the body members 50. Additionally, other means of securing the tie rods in the body members to join the body members together, such as pins, nubs or the like are also contemplated without departing from the scope of the invention.

Each body member 50 also contains a pair of spring-receiving holes 80 extending into the body member from the medial face 52 thereof. In one embodiment, the spring-receiving holes 80 extend a portion of the width of the member 50 but less than the entire width. The spring-holes 80 in the adjacent medial faces 52 of the members 50 are aligned so that a spring 82 is received into the aligned holes in the members. Suitably, each member 50 has a spring-receiving hole 80 on each side of the aperture 54. The springs 82 operate by pushing against a surface 84 at the end of the spring-receiving holes 80 to normally bias the body members 50 away from each other thereby forming the central gap 56. Other means of biasing the body members away from each other or urging the body members apart, such using air cylinder or sponge rubber springs, may also be used without departing from the scope of the invention. For example, springs may be located within the tie rods 60 and the tie rods configured to expand and contract in a telescoping fashion to join the body members 50 and provide the desired bias. Additionally, the springs may be formed as part of the body members 50 such as a molded leaf spring.

The body members 50 have a recess 90 in an upper surface 92 thereof (FIG. 1). The recess 90 is in registry with the arcuate cutout 54 and has a substantially similar but larger shape as the arcuate cutout 54 but does not proceed through the entire thickness of the body members 50 such that the recesses in the body members 50 combine to form a generally circular recess when the bodies are in the extended position.

Each of the body members 50 have a neck 94 extending from a lower face 96 thereof in registration with the arcuate cutout 54. The neck 94 suitably has an arcuate shape similar to the shape of the arcuate cutout 54. An inner surface 95 of the neck is suitably recessed slightly from the arcuate cutout 54 such that it generally encircles the pedestal 38 when the clamp 16 is installed on the can 12 such that the valve stem 40 is centered in the aperture 58. A toe 98 extends in a radially outward direction from the lower portion of the neck 94. As shown in FIGS. 5 and 7, opposite lateral ends 100 of the neck 94 and toe 98 are truncated such that the neck and toe form less than a complete circular extension and can be fitted through the overhanging rim 39 of the can 12. In one embodiment, the toes 98 have a diameter D in the spread configuration of between about 0.9 and about 1.2 inches, and more suitably between about 1.0 and about 1.1 inches, and have a truncated length L between about 0.5 and about 0.8 inches and more suitably between about 0.6 and about 0.7 inches, although other dimensions are contemplated depending on the size of valve 34 on the aerosol can 12. The neck 94 and toe 98 have a complementary shape with the recess 37 such that the toe fits into the dimple 41 and engages the overhanging rim 39 to securely clamp the adapter clamp 16 to the top of the aerosol can 12.

Clamping of the adapter clamp 16 to the aerosol can 12 is accomplished by squeezing the two members 50 together against the force of the springs 82 so that the medial faces 52 of the members substantially abut each other to thereby create a smaller diameter across the radially extending toes 98 as shown in FIG. 5. With the body members 50 squeezed together, the toes 98 are able to be inserted past the overhanging rim 39 in the valve 34 and into the recess 37. The truncated ends 100 of the toe 98 and neck 94 enable the ends to also be inserted past the overhanging rim 39. When the squeezing force is removed, the springs 82 push the two body members 50 apart and into the spread configuration with the body members 50 separated from each other by the amount permitted by the tie rods 60.

With the adapter clamp 16 inserted on the aerosol can 12, the adapter 20 can be fluidly connected to the can. As the adapter 20 is threaded into the aperture 58 of the adapter clamp 16, a bottom edge 101 contacts the pedestal 38 and results in an upward pull on the adapter clamp to securely engage the toe 98 with the overhanging rim 39. As illustrated in FIG. 2, when the threaded portion 24 of the adapter 20 is screwed into the aperture 58, an internal wall 102 of the adapter contacts the valve stem 40 and exerts a downward force on the valve stem to open the valve 34 and cause the contents of the aerosol can 12 to be released through the delivery passage 42. The delivery passage 42 is in fluid communication with a passage 104 in the adapter 20 allowing the pressurized contents of the aerosol can 12 to pass to the delivery system 14. Flow of the contents of the aerosol can 12 through the hose 22 can be controlled by valve 26 or a trigger on the spray nozzle (not shown). Alternately, the adapter 20 can be configured to permit movement of the adapter so that the valve 34 controls flow to the delivery system 14 by allowing the adapter to engage and disengage the valve stem 40.

Figure 8:
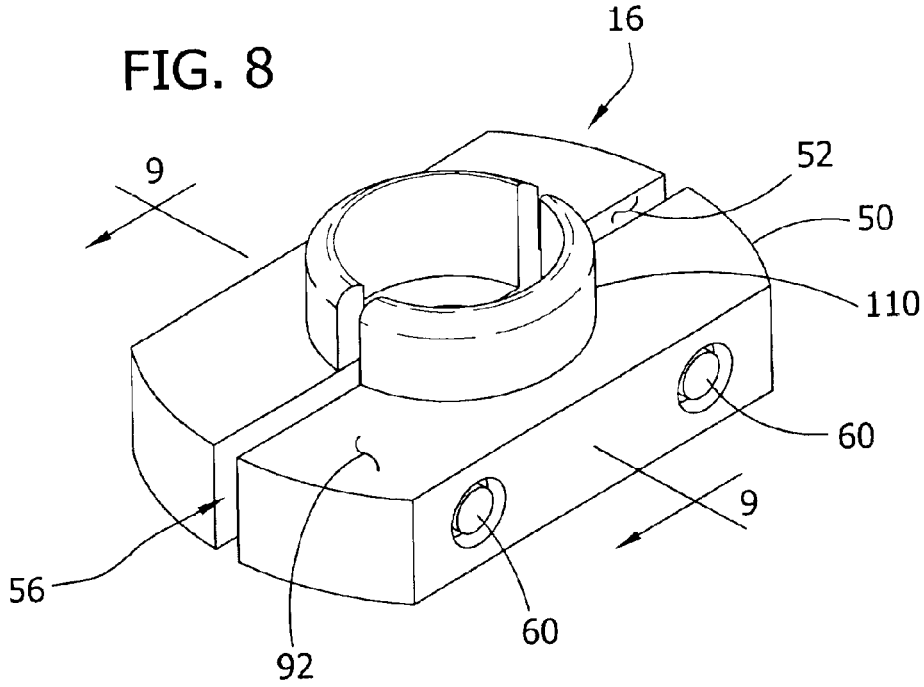
FIG. 8 is a perspective view of a second embodiment of the adapter clamp.
Figure 9:
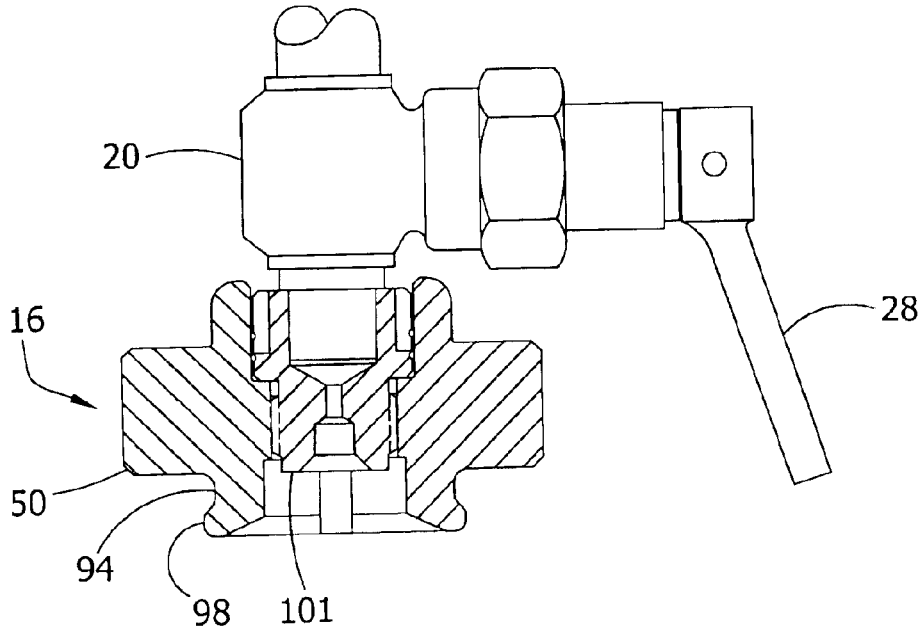
FIG. 9 is a section view of the second embodiment of the adapter clamp with the adapter of the delivery system attached.

FIG. 8 illustrates another embodiment of the adapter clamp 16 wherein the body members 50 have an arcuate wall 110 extending from an upper surface 92. The wall 110 is in registration with and radially outward from the arcuate cutout 54 such that the adapter 20 must be properly aligned with the aperture 58 for the adapter to be connected to the adapter clamp 16 as illustrated in the sectional drawing in FIG. 9. The arcuate wall 110 is configured to prevent cross-threading of the threaded portion 24 of the adapter 20 with the threads on the arcuate cutout 54 while attaching the adapter to the adapter clamp 16.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. An adapter clamp configured to be received on the top of an aerosol can suitable for enabling a delivery system to be fitted to the top of the aerosol can, the adapter clamp comprising:

a pair of body members oriented in a side-by-side relationship such that medial faces of the clamp members are in a facing relationship, each of said members having an arcuate cutout in the medial face, the arcuate cutouts combining to form an aperture through which the delivery system contacts the aerosol can, wherein each body member has an arcuate neck with a radially protruding toe extending from a bottom surface thereof in registration with the arcuate cutout and configured to be received in a recess in the top of the aerosol can;

at least one connector slidably joining the body members such that the members are adapted to move between a spread configuration wherein the body members have a gap therebetween having a selected width and a compressed configuration wherein the members substantially abut each other, wherein the aperture has a circular shape when the body members are in the spread configuration for receiving an adapter of the delivery system; and at least one spring member configured to push the body members apart thereby biasing the members to the spread configuration;

wherein when the body members are squeezed together to the compressed configuration against spring pressure, the toes can be inserted past a rim partially overhanging said recess in the aerosol can, and when the body members are returned to the spread configuration, the toes engage the overhanging rim to clamp the adapter clamp to the aerosol can.

2. An adapter clamp as claimed in claim 1 wherein two connectors join the body member, wherein the connectors are located on opposite sides of the aperture.

3. An adapter clamp as claimed in claim 1 wherein faces of the arcuate cutout are threaded.

4. An adapter clamp as claimed in claim 1 wherein two springs bias the body members in a spread condition, wherein the springs are located on opposite sides of the aperture.

5. An adapter clamp as claimed in claim 1 wherein opposite ends of the neck and the toe on each body member are truncated so that the ends can fit between the overhanging rim of the can.

6. An adapter clamp as claimed in claim 5 wherein the toes have a truncated length that is between about 50% and about 80% of the diameter across the toes when the body members are in the spread configuration.

7. An adapter clamp as claimed in claim 1 wherein the connector comprises a tie rod having a groove in at least one end, said groove receiving a clip for contacting the body member to secure the tie rod in the body members.

8. An adapter clamp as claimed in claim 1 wherein the gap between the body members in the spread configuration is between about 0.10 inches and about 0.15 inches.

9. An adapter clamp as claimed in claim 1 wherein at least one of the body members further comprises an arcuate wall extending from an upper surface thereof in registration with and radially outward from the arcuate cutout to properly align the adapter with the aperture.

10. An aerosol application system comprising:

an aerosol can having a valve comprising a pedestal and a mounting cup forming an annular recess around said pedestal and a rim overhanging a portion of said recess;

a delivery system comprising an adapter having a threaded portion;

an adapter clamp for connecting the delivery system to the aerosol can comprising:

a pair of body members oriented in a side-by-side relationship such that medial faces of the clamp members are in a facing relationship, each of said members having an arcuate cutout in the medial face, the arcuate cutouts combining to form an aperture through which the delivery system contacts the aerosol can, wherein each body member has an arcuate neck with a radially protruding toe extending from a bottom surface thereof in registration with the arcuate cutout and configured to be received in the recess in the aerosol can;

at least one connector slidably joining the body members such that the members are adapted to move between a spread configuration wherein the body members have a gap therebetween having a selected width and a compressed configuration wherein the members substantially abut each other, wherein the aperture has a circular shape when the body members are in the spread configuration for receiving the threaded portion of the adapter; and at least one spring member configured to push the body members apart thereby biasing the members to the spread configuration;

wherein when the body members are squeezed together in the compressed configuration against spring pressure, the toes can be inserted past the rim overhanging said recess, and when the body members are returned to the spread configuration, the toes engage the overhanging rim to clamp the adapter clamp to the aerosol can.

11. The aerosol application assembly of claim 10 wherein the delivery system comprises a flexible hose and an adapter comprising a circular threaded portion configured be threaded into the aperture.

12. The aerosol application assembly of claim 10 wherein two connectors join the body member, wherein the connectors are located on opposite sides of the aperture.

13. The aerosol application assembly of claim 10 wherein faces of the arcuate cutout are threaded.

14. The aerosol application assembly of claim 10 wherein two springs bias the body members in a spread condition, wherein the springs are located on opposite sides of the aperture.

15. The aerosol application assembly of claim 10 wherein opposite ends of the neck and the toe on each body member are truncated so that the ends can fit between overhanging rim of the can.

16. The aerosol application assembly of claim 15 wherein the toes have a truncated length that is between about 50% and about 80% of the diameter of the toes when the body members are in the spread configuration.

17. The aerosol application assembly of claim 10 wherein the connector comprises a tie rod having a groove in at least one end, said groove receiving a clip for contacting the body member to secure the tie rod in the body members.

18. The aerosol application assembly of claim 10 wherein the gap between the body members is between about 0.10 inches and about 0.15 inches when the body members are in the spread configuration.

19. The aerosol application assembly of claim 10 wherein at least one of the body members further comprises an arcuate wall extending from an upper surface thereof in registration with and radially outward from the arcuate cutout to properly align the adapter with the aperture.

* * * * *